US005204489A

United States Patent [19]

Pellarin et al.

[11] Patent Number: 5,204,489

[45] Date of Patent: Apr. 20, 1993

[54] MODULAR AND RECONFIGURABLE EPISCOPIC SIGHT

[75] Inventors: Jean-François R. Pellarin, Saint Cyr l'Ecole; Gilles M. Colin, Meudon, both of France

[73] Assignee: GIAT Industries, France

[21] Appl. No.: 628,012

[22] Filed: Dec. 17, 1990

[30] Foreign Application Priority Data

Dec. 20, 1989 [FR] France ..... 89 16888

[51] Int. Cl.[5] ..... F41G 1/40; F41G 3/22

[52] U.S. Cl. ..... 89/41.19; 89/41.06; 359/403; 359/428; 359/431

[58] Field of Search ..... 89/36.14, 41.06, 41.19, 89/41.22; 350/538, 540, 541, 542, 557, 566, 569

[56] References Cited

U.S. PATENT DOCUMENTS

| | | | |
|---|---|---|---|
| 2,219,314 | 10/1940 | Hoch | 350/540 |
| 3,462,604 | 8/1969 | Mason | 89/41.06 |
| 3,539,243 | 11/1970 | Scidmore | 89/41.06 |
| 3,918,813 | 11/1975 | Rossiter | 350/556 |
| 3,997,762 | 12/1976 | Ritchie et al. | 89/41.06 |
| 4,020,739 | 5/1977 | Piotrowski et al. | 89/41.03 |
| 4,542,986 | 9/1985 | Berdanier | 89/41.06 |
| 4,561,775 | 12/1985 | Patrick et al. | 356/5 |
| 4,669,809 | 6/1987 | Patry et al. | 350/1.1 |
| 4,822,994 | 4/1989 | Johnson et al. | 33/245 |

FOREIGN PATENT DOCUMENTS

| | | | |
|---|---|---|---|
| 860020 | 1/1971 | Canada | 350/538 |
| 57304 | 8/1982 | European Pat. Off. | 89/41.06 |
| 0117983 | 1/1984 | European Pat. Off. . | |
| 0165170 | 6/1985 | European Pat. Off. . | |
| 0268778 | 9/1987 | European Pat. Off. . | |
| 0345408 | 6/1988 | European Pat. Off. . | |
| 3142704 | 10/1981 | Fed. Rep. of Germany . | |
| 3329589 | 8/1983 | Fed. Rep. of Germany . | |
| 858407 | 11/1940 | France | 350/557 |
| 1165604 | 10/1969 | United Kingdom | 350/557 |
| 2143964 | 2/1985 | United Kingdom | 89/36.14 |

OTHER PUBLICATIONS

Handbook on Operation and Maintenance Instructions, Navigational and Computing View Finder (NAVAER 10), Oct. 15, 1957, pp. i–ii and 1–16.

*Primary Examiner*—Stephen M. Johnson
*Attorney, Agent, or Firm*—Parkhurst, Wendel & Rossi

[57] ABSTRACT

The invention relates to an episcopic sight usable for observation and firing by day or night on a vehicle equipped with a gun. The sight includes an assembly of interchangeable moduli grouping the optical elements, particularly made of a head modulus 1 containing a mirror controlled in elevation, a height increase modulus 2, a day sight modulus 4, a night sight modulus 5, a rangefinder modulus 6, an electronic case associated to a fire-control computer. It includes a modulus of separation 3 of the day and night channels interposed between the height increase modulus 2, and the day and night moduli 4, 5, the modulus of separation 3 containing the means for generating a sight reticle in the day and night channels. The means of generating a firing reticle include a projection collimator of this reticle and a rhombohedron to inject this reticle into the day and night moduli.

10 Claims, 4 Drawing Sheets

1
41
2
3
4
5
6
34
7
8
9

MODULAR AND RECONFIGURABLE EPISCOPIC SIGHT

BACKGROUND OF THE INVENTION

1. Field of the Invention

The technical field of this invention is modular type and reconfigurable episcopic sights used for observation and ensuring firing when it is associated with a weapon system with or without a fire control system.

In general, the observation function must allow:

detection by an episcope or a low magnitude sight, recognition and identification, night vision by the use of light intensifier tubes, thermal cameras, and night lens rangefinding (battle tank or artillery observation vehicle).

Usually, a sight reticle is associated with laser emission and reception for day and night lens rangefinding.

In the same way, the firing function must ensure the generation of a day and night axis of sight, which is referenced to the axis of the gun or shooting axis therefore allowing firing corrections taking into account only the distance (engraved reticle with ballistic graticules and stadimetric scale, or engraved reticle with ballistic graticule and rangefinder), or firing corrections in elevation and azimuth integrating a greater number of parameters: distance, speed of the target, temperature, altitude, type of ammunition, wind, etc. These deviations are then quantified by a computer. The sighting offset can be carried out, either by the displacement of a deviative optical device, or by the displacement of a reticle (mechanical or electronically addressable movement).

It might be possible within the framework of the training of the users to define an instruction function, which involves the installation of a video camera connected to a controlling monitor picking up the image observed by the trainee. One must then be able to distinguish the superposition of the various sight reticles on the landscape (target).

The various traditional functions ensured by sights shows that differing means are needed due to:

the day/night use, the required operational functions, stand-by mode (observation), firing mode, instruction mode.

2. Description of Prior Art Devices

To answer this diversity, general-purpose systems which are very bulky, very complicated and thus very expensive, or small, more economic telescopes meeting only partially the needs of the user and which are not very evolutionary, or modular sights having several configurations have been proposed to meet the needs of the customer.

In this last case, either fixed configurations which are defined when purchasing, or configurations allowing the adaptation of new moduli according to needs, are known. The known modular sights generally do not always have great flexibility of use and have the following disadvantages:

slow assembly and disassembly of the moduli, sometimes requiring tools, loss of harmonization between the sight axis and the weapon axis or between the sight axis and the laser emission/reception axes. This lack of fidelity leads to a procedure of harmonization with installation of a target board and muzzle boresight, which is completely unsuited for daily use such as, for example, the replacement of an episcopic channel with a light intensifier modulus.

The object of this invention is to propose a modular and reconfigurable episcopic sight ensuring accurate firing through two optical channels while keeping the same sight reference mark despite whatever moduli is used.

SUMMARY OF THE INVENTION

The object of this invention is an episcopic sight usable for day and night observation and firing, mounted on a vehicle equipped with a gun, characterized in that it includes a unit of interchangeable moduli grouping the optical elements made of, in particular, a head modulus containing a head mirror, a day vision modulus, a night vision modulus, a rangefinder modulus, an electronic case associated with a fire-control computer, a modulus separating the day and night channels interposed between the head modulus, wherein the modulus of separation contains means for generation of a sight reticle for projection in the day and night moduli.

The means for generation of the sight reticle can include a projection collimator of the reticle and a rhombohedron to inject this reticle into the day and night moduli.

The collimator can include a diode illuminating, in transmission, the firing reticle harmonized in elevation and azimuth with respect to the firing axis.

The rhombohedron can comprise two treated faces, placed opposed to the day and night moduli, the first face reflecting part of the radiation emitted by the diode towards the night modulus and transmitting another part of the radiation towards the second face, which reflects the received radiation towards the day modulus.

An adaption spacer comprising a height increase modulus can be interposed between the head modulus and the modulus of separation. The day modulus can comprise optical means capable, in combination with the head mirror, of transmitting the image of the external landscape towards the observer.

The night modulus can comprise optical means made of, in particular, a lens, an image intensifier tube and an eyepiece capable of transmitting towards the observer the image of the external landscape at night.

The laser rangefinder can be attached to the day sight modulus, the laser rangefinder reticle being integrated in the day modulus and being harmonized with the laser transmission and reception beams.

A dichroic cube can be fixed in the day modulus before the laser reticle to reflect the laser reception beam towards the rangefinder modulus and to transmit the visible radiation towards the eyepiece of the day modulus.

The reticle of the laser rangefinder can be injected into the night modulus by means of the rhombohedron and cube corner whose base is placed near the first face of the rhombohedron and at 45° with respect to the latter.

The first face of the rhombohedron can be treated to ensure practically total transmission and a partial reflection of the radiation emitted by the diodes illuminating the rangefinder and firing reticles.

The head modulus and the modulus of separation can be assembled rigidly on the turret of the vehicle, the axis of sight being harmonized in elevation and azimuth with the axis of the gun, the day and laser moduli on the one hand and the night modulus on the other hand being connected to the modulus of separation by a snap fastener attachment device.

An advantage of this invention lies in the creation of a single sight reticle which is kept independent of the assembly or disassembly of the modules constituting the two sighting channels.

Another advantage lies in the fact that it allows very accurate rangefinding corresponding to a perfect harmonization between the laser transmission/reception beams and the laser axis of sight available in the two channels.

BRIEF DESCRIPTION OF THE DRAWINGS

Other advantages will be apparent when reading the additional description given hereafter in relation to the drawings where.

DETAILED DESCRIPTION OF THE PREFERRED EMBODIMENTS

Figure 1:
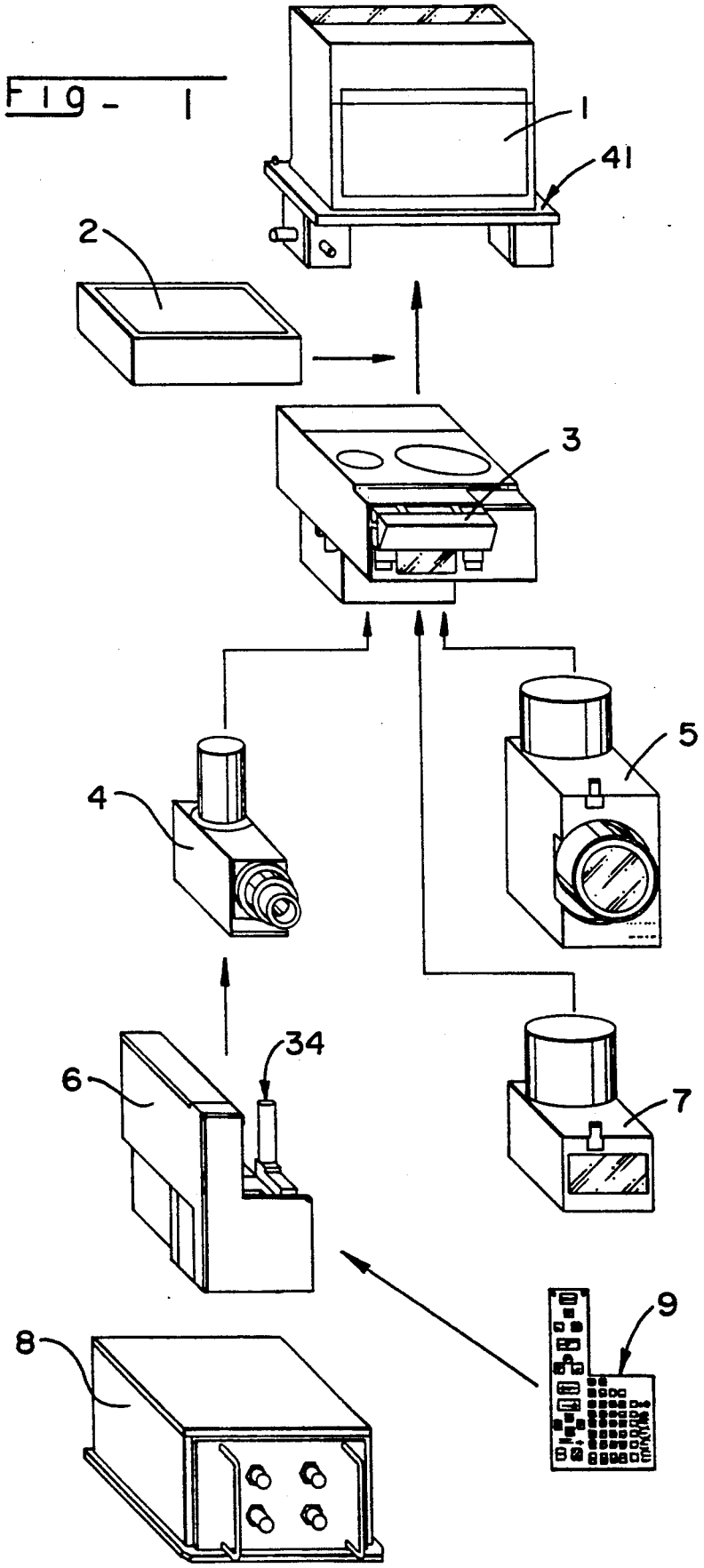
FIG. 1 is an exploded view showing the various moduli constituting the sight.

FIG. 1, represents an exploded view of the sight illustrating an optimal configuration which comprises a head modulus 1, a height increase modulus 2, a modulus of separation 3, a day sight modulus 4, a night sight modulus 5, a laser rangefinding modulus 6, an episcopic and clear collimator 7, an electronic case 8 and a computer 9. Of course, according to the needs of the user, the configuration will be modified and a basic configuration including moduli 1–4 will be available. The head modulus 1 includes a head mirror 10, controlled in elevation, allowing the observation of the landscape and by which the rangefinding and firing on a target are carried out. The frame of modulus 1 is fixed on the turret of the armored vehicle through the surface of fixation 41 ensuring the positioning compared to the axis of the gun. This mechanical operation is known to the expert and will be illustrated in relation to FIG. 5. The height increase modulus 2 is fixed under modulus 1 and it allows for the adaptation of the sight, according to the invention, to different turret configurations. The modulus of separation 3 fixed under modulus 1 ensures two functions. First, it allows the generation of an axis of sight projected in the day and night channels limited by moduli 4, 5. The modulus of separation constitutes a structure to receive the lower moduli 4–9 which are fixed by means of snap fasteners 42.

The lower moduli are a focal systems (the landscape placed before the objective is observable at the other end of the modulus, while not having been magnified). This property has the advantage to allow a great tolerance in positioning with respect to the modulus of separation.

Figure 3:
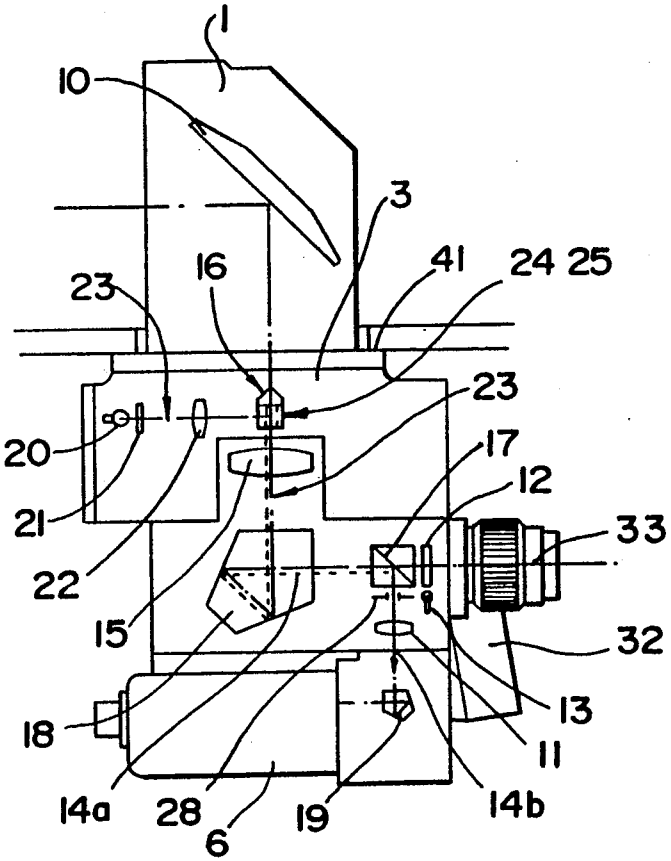
FIG. 3 is a cross-section of the sight showing the structure of the modulus of separation.

FIG. 3 shows head mirror 10 projecting the external landscape image towards the day modulus 4 by means of prism 18, which reflects it towards eyepiece 33. To determine the distance of (rangefind) a target, laser 6 is used whose rangefinding reticle 12 is integrated in the day modulus 4. This reticle is illuminated laterally by diode 13. The produced beam 14*a* is visible by the operator in eyepiece 33. It is transmitted towards the night modulus 5 by a rhombohedron 24 and a cube corner 16 described in detail in FIG. 3, after reflection in prism 18.

FIG. 3 also shows the path of the laser reception beam 14*b* reflected by the target, after reflection by mirror 10. This beam 14*b* crosses objective 15 of the day modulus 4 and is transmitted by the prism 18 to a dichroic cube 17.

Cube 17, transparent to visible light, in turn reflects the beam 14*b* which, after reflection in the pentahedron 19, is received by rangefinder modulus 6. Between cube 17 and pentahedron 19, a field diaphragm 28 and an objective 11 are placed whose role is to ensure the harmonization between the beams 14*a* and 14*b* thus ensuring accurate rangefinding.

The laser transmission channel, not represented in this drawing, is generated parallel to the reception channel, and, in FIG. 1, the transmission lens 34 emits the laser beam directly towards the head modulus 10.

Figure 2:
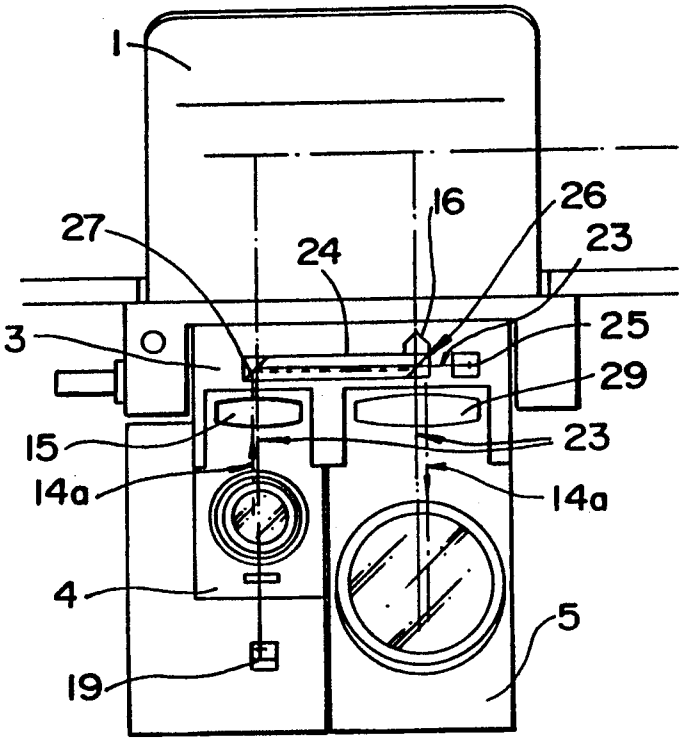
FIG. 2 is a perpendicular cross-section of FIG. 1 showing the structure of the day modulus.

FIGS. 2 and 3 show a cross-section of moduli 1 to 5; also showing a partial structure of sight reticle 21 which determines a sight optical axis. They are made of a collimator formed by a diode 20 illuminating an image plane defining sight reticule 21. The image plane can be either an engraved reticle with the indication of the firing corrections according to the distance (simplified configuration), or a liquid crystal display generating a reticle addressable in elevation and azimuth by a computer according to the various firing parameters: distance, type of ammunition, altitude, wind, temperature, etc. . . . (modern configuration). Then there is a lens 22 allowing combination of the image of reticle 21 and the image of the landscape. The beam is then reflected towards a rhombohedron 24 by the reflective face of a prism 25. The rhombohedron 24 is a system of projection allowing to superimpose in the two moduli 4 and 5, the image of reticle 21 and the image of the landscape coming from mirror 10. The advantage of this structure is the generation of parallel axes. This rhombohedron is made of two parallel faces 26 and 27 transparent to visible light. Face 26 reflects part of the luminous beam emitted by the diode 20 towards the night modulus 5 and transmits the other part to plate 27. On the contrary, the face 27 completely reflects the beam 23 received towards the day modulus 4.

FIG. 3 shows the path of the beam 14*a* materializing the laser rangefinding reticle 12 described more completely hereafter. This beam coming from the day modulus 4 is reflected completely by the face 27 towards face 26. To transmit this beam in the night modulus 5, a cube corner 16 is used whose transparent base is placed near the first face 26, at 45° with respect to the latter. The beam 14*a* is reflected partially by the face 26 towards the cube corner 16 and after a double reflection in the latter penetrates in the night modulus 5 after transmission by face 26.

Figure 4:
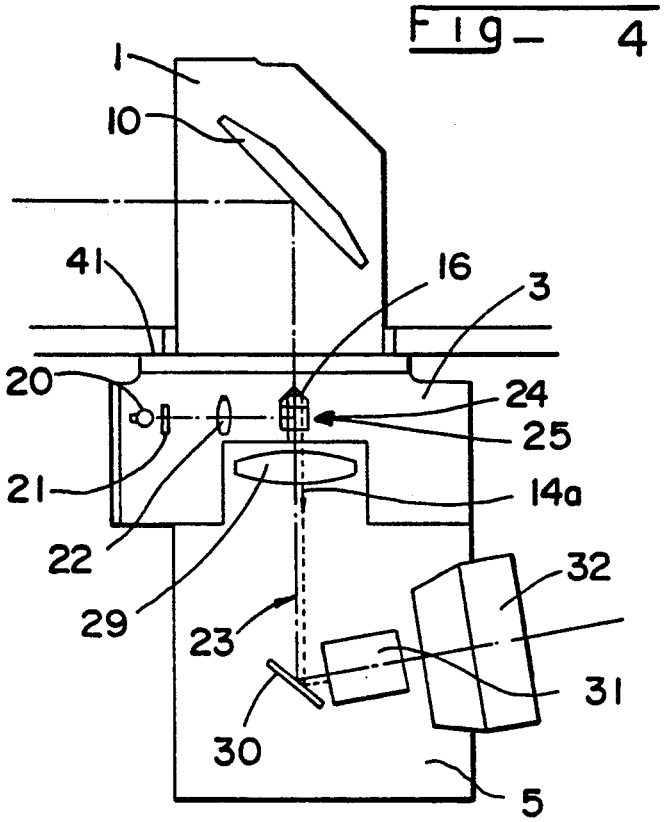
FIG. 4 is also a section of the sight showing the structure of the night modulus.

FIG. 4 illustrates a cross-section showing the structure of the night modulus 5. It includes a lens 29, a reference mirror 30, a light intensifier tube 31 and an eyepiece 32.

Figure 5:
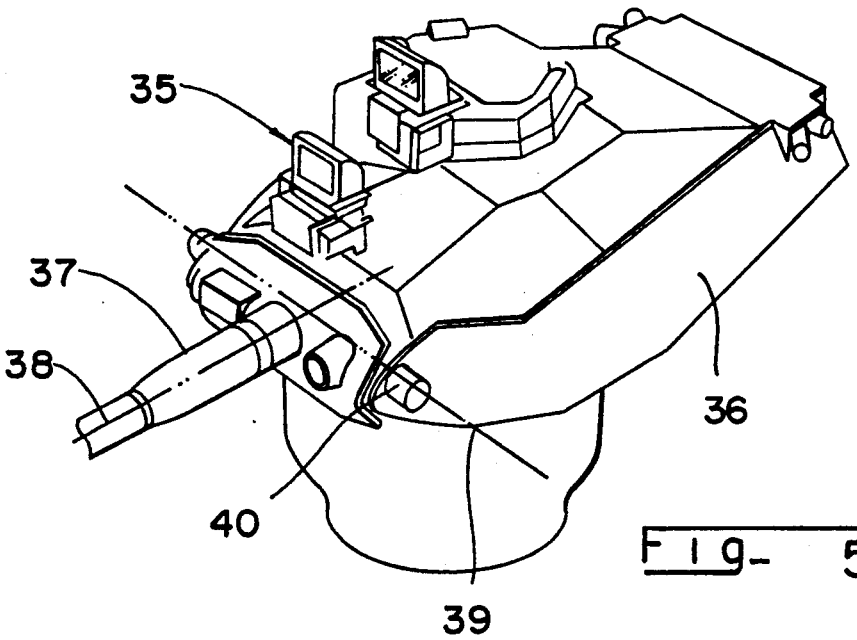
FIG. 5 shows the adaption of the sight according to the invention, on the turret of a combat vehicle.

FIG. 5 illustrates a sight 35 fixed on turret 36 through the attachment surface 41 represented in FIG. 1. Only the head modulus 1 is visible, the other moduli being fixed as indicated previously to this head modulus inside turret 36. This turret carries a gun 37 limiting a firing axis 38. Of course the gun is mobile in elevation around axis 39 of pivots 40. The optical axes of sight and laser rangefinding are of course harmonized in a traditional way with the firing axis 38 of the gun.

Figure 6:
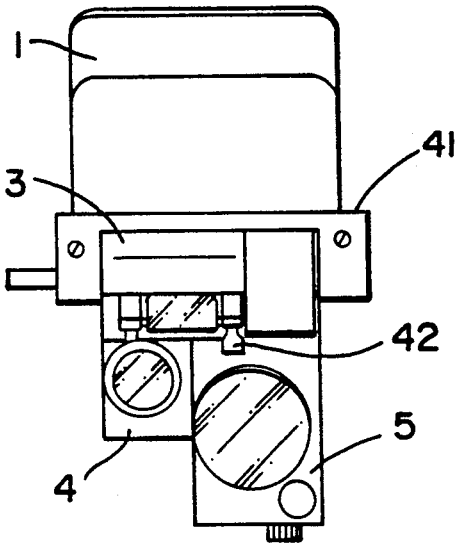
FIG. 6 shows a frontal view of the sight.

FIG. 6 shows a front view of the sight, which is similar to the cross-sectional view thereof shown in FIG. 2. In addition to the elements described in FIG. 2, FIG. 6 shows snap fastening device 42 which connects the night modulus 5 to the modulus of separation 3.

The firing function is realized by the harmonization of the axis of sight with the axis of the gun (in nominal position, they must be convergent in a point of the landscape). Then an angular shift in elevation and azimuth taking into account the ballistics of the ammunition and the various external parameters is carried out.

In this invention, the materialization of the axis of sight 23 by means of the sight reticle 21 is carried out by superimposing the image of this reticle on the image of the target by means of a projection optics (ad infinitum), interdependent of the modulus of separation 3. In the case described, the firing correction is carried out either by superimposing the target on the various horizontal lines of the micrometer corresponding to the firing corrections, or by aiming the target by means of a reticle addressable by the computer.

Due to the position of the rhombohedron of projection 24 placed above the objectives of the lower moduli 4–9, but forming integral part of modulus 3, a coherence of the harmonization of the axis of sight generated by modulus of separation 3 of the sight rigidly and definitely assembled on the turret and harmonized with the axis of the gun, is obtained.

This architecture frees one from the fidelity of assembly/disassembly, and the positioning of moduli 4 to 9. The function of modularity then is completely realized without the constraint of harmonization at each change of the lower moduli.

The harmonization of the direction of sight with that of the weapon is carried out by traditional means:

through the head mirror 10, displacement in elevation of the image of the target compared to the sight reticle 21, by rotating moduli units 1 and 3 around a nearly vertical axis of the turret ensuring the scanning in azimuth of the direction of sight, until coincidence with the point sighted by the weapon is established.

Another aspect of the firing function is the harmonization of sight axis with the laser transmission-reception channels.

The laser function is an optional part of day modulus 4. The laser reticle 12 is integrated in the image plane of the day channel as explained in relation to FIGS. 2 and 3 in order to present a certain coherence of harmonization.

The harmonization of the laser direction of sight with its transmission and reception beams is then carried out in the factory and remains constant independent of successive assemblies and disassemblies.

This harmonization of the day channel with the second optical channel could be difficult, but is overcome with the cube corner 16 as explained in relation to FIG. 3.

The difficulty lies in the realization of an axis of sight observable in the night channel and parallel to the laser transmission and reception beams, each of these two elements being associated with different moduli having a large tolerance in relative positioning (assembly/disassembly).

According to this invention, one uses the laser direction of sight defined by lens 15 and its image plane fitted with a laser reticle 12 in modulus 4, as explained in relation to FIG. 2. Laser reticle 12 (which may be an engraved micrometer) is supplied with a lighted cross-section in order to improve the contrast in the event of aiming on a dark surface.

The total architecture of the system allows for recovery of a small quantity of light reflected in engravings optimized for this purpose. The projection in the night channel is then possible by adding the cube corner 16.

This projection of laser reticle 12 having a very low light intensity can be used with a very sensitive image intensifier modulus.

On the other hand, the assembly of a modulus video camera does not allow the use of the projected image. Indeed, video cameras being equipped with an automatic gain control, which carries out a measurement of the total brightness of the target, do not allow the recovery of the image of the reticle whose brightness is very often much lower than that of the landscape observed.

This disadvantage is overcome by using a method of boresighting suitable for the invention. The procedure is as follows:

occultation of the peep-hole of mirror 10 by means of a suitable mask in order to obtain a maximum contrast (reticle projected on black background).

harmonization of a video reticle with the projected one.

This video reticle can be of two types:

a reticle mechanically adjustable in elevation and azimuth and projected in the video channel (upstream of the camera).

a reticle electronically addressable on the associated monitor. This type of assembly requires the user to renew the boresighting again after each disassembly of the video unit, which is acceptable for an instruction mode.

The operational phases of the sight according to the invention are as follows:

1) aiming at the target by means of reticle 12 and simultaneous rangefinding, 2) manual corrections of the firing parameters or by means of a computer 8 which carries out these corrections automatically, 3) aiming at the target by means of reticle 21, 4) firing.

We claim:

1. A modular episcopic sight for day and night observation and firing of a gun for a vehicle, said gun defining a firing axis, comprising:

a head module containing a head mirror adapted for rigid connection to said vehicle;

a module of separation adapted for rigid attachment to said vehicle for receiving an image from said head mirror, wherein said module of separation includes a sight reticule and means for generation of an image of said sight reticule; and a detachable day module and a detachable night module cooperable with said module of separation such that said image of said sight reticule is projected into said day and night modules, wherein said means for generation of an image of said sight reticule comprises:

(a) a projection collimator defined by a diode for illuminating said sight reticule; and (b) a rhombohedron to project said image of said sight reticule into said day and night modules, wherein said rhombohedron comprises a first face opposite said night module and a second face opposite said day module, said first face treated to reflect a portion of radiation emitted by said diode toward said second face and to transmit another portion of radiation to said night module, said second face treated to reflect said portion of radiation to said day module.

2. The device of claim 1, further comprising a height increase module inserted between said head module and said module of separation.

3. The device of claim 1, wherein said day module comprises:

a lens cooperable with an image reflected from said head mirror;

a prism positioned to receive said image after passing through said lens; and an eyepiece positioned to receive said image after reflection in said prism, thereby allowing an observer to view said image through said eyepiece.

4. The device of claim 1, wherein said night module comprises:

a lens cooperable with an image reflected from said head mirror;

an image intensifier tube positioned to receive said image after passing through said lens; and an eyepiece positioned to receive said image after passing through said image intensifier tue, thereby allowing an observer to view said image through said eyepiece.

5. A modular episcopic sight for day and night observation and firing of a gun for a vehicle, said gun defining a firing axis, comprising:

a head module containing a head mirror adapted for rigid connection to said vehicle;

a module of separation adapted for rigid attachment to said vehicle for receiving an image from said head mirror, wherein said module of separation comprises a sight reticule and means for generation of an image of said sight reticule;

a detachable day module and a detachable night module cooperable with said module of separation such that said image of said sight reticule is projected into said day and night modules;

a detachable laser rangefinder module adapted for attachment to said day module; and a laser rangefinder reticule illuminated by a diode in said day module, said laser rangefinder reticule being harmonized with transmission and reception beams generated by said laser rangefinder module.

6. The device of claim 5, further comprising a fire-control computer for calculation of firing parameters.

7. The device of claim 5, wherein said day module comprises an eyepiece to allow an observer to view said image through said eyepiece, said device further comprising a dichroic cube positioned in said day module to reflect said reception beam toward said laser rangefinder and to transmit visible radiation to said eyepiece.

8. The device of claim 7, wherein said module of separation comprises a rhombohedron having a first face and a second face, and a cube corner whose base is placed near said first face of said rhombohedron at an angle of 45° with respect to said first face, said rhombohedron and said cube corner positioned to project and image of said laser reticule into said night module.

9. The device of claim 8, wherein said second face is treated to substantially totally reflect radiation emitted by said diode, and said first face is treated to partially reflect radiation emitted by said diode, thereby projecting said image of said laser rangefinder reticule into said day and night modules.

10. A modular episcopic sight for day and night observation and firing of a gun for a vehicle, said gun defining a firing axis, comprising:

a head module containing a head mirror adapted for rigid connection to said vehicle;

a module of separation adapted for rigid attachment to said vehicle for receiving an image from said head mirror, wherein said module of separation comprises a sight reticule and means for generation of an image of said sight reticule;

a detachable day module and a detachable night module cooperable with said module of separation such that said image of said sight reticule is projected into said day and night modules; and a detachable laser rangefinder module adapted for attachment to said day module, wherein said head module and said module of separation are adapted for rigid assembly on a turret of said vehicle such that a sight axis associated with said sight reticule is harmonized in elevation and azimuth with said firing axis, and wherein said day module and said laser rangefinder module, and said night module is connected to said module of separation by a snap fastener device.

* * * * *